US005582703A

United States Patent [19]

Sluzky et al.

[11] Patent Number: 5,582,703

[45] Date of Patent: Dec. 10, 1996

[54] METHOD OF FABRICATING AN ULTRA-HIGH RESOLUTION THREE-COLOR SCREEN

[75] Inventors: Esther Sluzky, Carlsbad, Calif.; Santosh K. Kurinec, West Henrietta, N.Y.; Kenneth R. Hesse, Escondido, Calif.; Luigi Ternullo, Jr., Colchester, Vt.

[73] Assignee: Palomar Technologies Corporation, Carlsbad, Calif.

[21] Appl. No.: 354,342

[22] Filed: Dec. 12, 1994

[51] Int. Cl.[6] ..... C25D 13/02

[52] U.S. Cl. ..... 204/485; 204/490; 204/491

[58] Field of Search ..... 204/181.1, 181.5

[56] References Cited

U.S. PATENT DOCUMENTS

| | | | |
|---|---|---|---|
| Re. 31,053 | 10/1982 | Firtion et al. | 430/396 |
| 3,475,169 | 10/1969 | Lange | 96/1 |
| 3,549,368 | 12/1970 | Collins et al. | 96/35.1 |
| 3,592,112 | 7/1971 | Frey | 95/1 R |
| 3,623,867 | 11/1971 | Saulnier | 96/36.1 |
| 3,653,941 | 4/1972 | Bell et al. | 117/33.5 C |
| 3,681,222 | 8/1972 | Gupton | 204/181.5 |
| 3,681,223 | 8/1972 | Gupton, Jr. | 204/181 |
| 3,714,011 | 1/1973 | Grosso et al. | 204/181.5 |
| 3,898,146 | 8/1975 | Rehkopf et al. | 204/181 |
| 3,904,502 | 9/1975 | Phillips | 204/181 |
| 3,963,639 | 6/1976 | Klein | 252/301.36 |
| 4,130,472 | 12/1978 | Kaplan et al. | 204/181.5 |
| 4,563,241 | 6/1986 | Tanaka et al. | 156/643 |
| 4,891,110 | 1/1990 | Libman et al. | 204/181.5 |

OTHER PUBLICATIONS

E. Sluzky et al, "Electrophoretic Preparation of Phosphor Screens", *Journal of the Electrochemical Society*, vol. 136, No. 9, pp. 2724–2727 (Sep. 1989).

*Primary Examiner*—Kathryn Gorgos
*Assistant Examiner*—Kishor Mayekar
*Attorney, Agent, or Firm*—Rodney F. Brown

[57] ABSTRACT

Phosphor color screens with triad pitches of 150 μm and less are fabricated by a combination of modified microelectronic processing techniques and electrophoretic coating of the phosphors and black screen. Indeed, triad pitches based on 15 μm color line width and 5 μm black matrix between colors are achievable. The method of the invention for fabricating a three-color screen comprises (a) forming a conductive coating on a major surface of the substrate; (b) forming multiple masking layers on the conductive coating; (c) patterning the masking layers in a prescribed pattern to form a first plurality of openings therein to expose first portions of the conductive coating; (d) electrophoretically depositing a first phosphor on the exposed first portions of the conductive coating; and (e) repeating steps (b) through (d) three times (1) to deposit a second phosphor on second portions of the conductive coating, (2) to deposit a third phosphor on third portions of the conductive coating, and (3) to deposit a black layer around all three color portions, to thereby define a plurality of triads of said first, second, and third colors in spaced relationship, separated by the black layer.

20 Claims, 5 Drawing Sheets

METHOD OF FABRICATING AN ULTRA-HIGH RESOLUTION THREE-COLOR SCREEN

BACKGROUND OF THE INVENTION

1. Field of the Invention

The present invention relates to fabricating color screens, and, more particularly, to fabricating ultra-high resolution three-color screens.

2. Description of Related Art

Phosphor screens for high density television (HDTV) cathode ray tubes (CRTs) are currently made having a triad pitch of the order of 0.75 to 1.0 mm (750 to 1,000 μm). As used herein, the phrase "triad pitch" refers to the distance across the three phosphor colors, including any separation between the phosphors, to the beginning of the next set of phosphors. The triad geometry may be either lines, dots, or any other configuration capable of being generated by conventional mask-making techniques. Phosphor screens for use in computer terminals have a minimum triad pitch of approximately 0.28 mm (280 μm). Such phosphor screens are considered state-of-the-art at present.

The cathode ray tubes are built in sizes ranging from approximately 10 inch diagonal to super-large tubes of the order of 36 inch diagonal. The larger tubes will have larger triad pitches and make up for that by the large diameter (or diagonal) of the display area, so that the overall horizontal and vertical resolutions are the same between small and large diameter tubes. The electron guns must complement the screen resolution.

Future color tubes for use in "Heads Up" displays (HUD) for aircraft cockpits require very high resolution in a very small tube. Tube diameters are of the order of one inch (2.54 cm) maximum. In order to achieve resolution in these tubes approaching that of the larger tubes mentioned above, it is necessary to greatly increase the resolution capability of the screens. Instead of dealing with triad pitches of the order of 0.28 mm (280 μm), screens must be fabricated with triad pitches of the order of 150 μm and less. Naturally, the source of electrons to bombard the triads and produce cathodoluminescence must also be capable of producing a complementary resolution. Additionally, the advent of new designs in flat panel displays offer the possibility of improved resolution in these devices if higher resolution screens were available. For example, the development of field emission flat panels can make microscopically small, sharp point emitters with conventional microelectronic processing. The very fine spacing of these emitters can make use of the higher resolution color screens described herein. The same situation exists in electroluminescent flat panels and plasma panel displays, where the screen addressing circuitry, fabricated by microelectronic methods, vastly outperforms the conventional present day screen resolution capability. The situation requires a drastic change in the technology of making color screens.

Thus, there is a need to fabricate phosphor color screens with triad pitches of 150 μm and less.

SUMMARY OF THE INVENTION

In accordance with the invention, phosphor color screens with triad pitches of 150 μm and less are fabricated by a combination of modified microelectronic processing techniques and electrophoretic coating of the component phosphors and black surround material. Indeed, triad pitches based on 15 μm color line width and 5 μm spacing between colors are achievable.

The method of the invention for fabricating a three-color screen having a triad pitch of less than 150 μm on a substrate, comprises:

(a) forming conductive coating on a major surface of the substrate;

(b) forming at least one masking layer on the conductive coating;

(c) patterning the masking layer(s) in a prescribed pattern to form a first plurality of openings therein to expose first portions of the conductive coating;

(d) electrophoretically depositing a first phosphor on the exposed first portions of the conductive coating; and (e) repeating steps (b) through (d) three times (1) to deposit a second phosphor on second portions of the conductive coating, (2) to deposit a third phosphor on third portions of the conductive coating, and (3) to deposit a black material on remaining portions of the conductive coating, between colors, to thereby define a plurality of triads of the first, second, and third colors, and a black background, in spaced relationship.

DESCRIPTION OF THE PREFERRED EMBODIMENTS

Figure 1A:
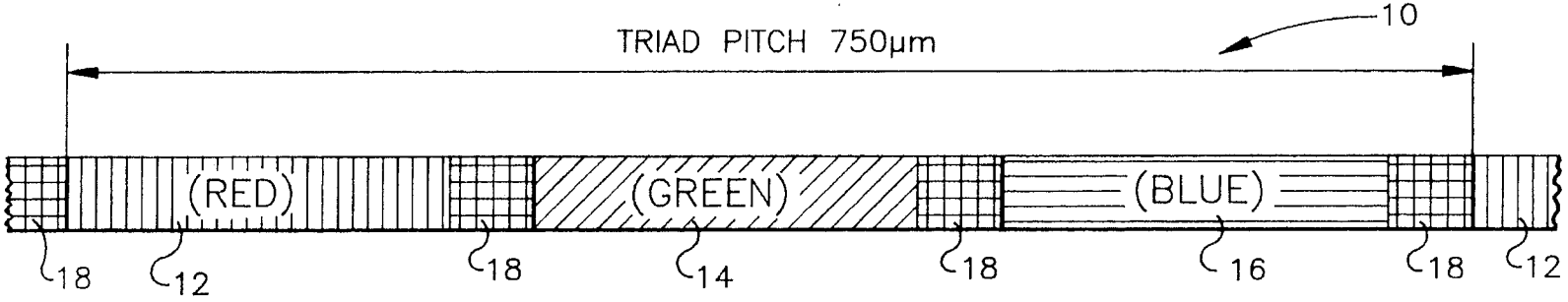
Fig. 1A PRIOR ART
FIGS. 1*a–b* are cross-sectional views, in schematic representation, of the triad pitch of a prior art TV screen (FIG. 1*a*) and of the triad pitch of a typical prior art VGA screen (FIG. 1*b*)
Figure 1B:
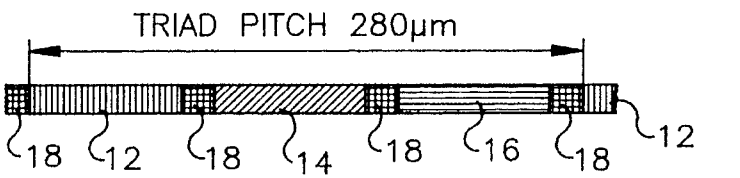
Fig. 1 B PRIOR ART
Figure 2:
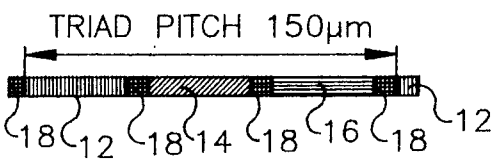
FIG. 2 is a view similar to that of FIG. 1, depicting the triad pitch of the color screen in accordance with the process of the present invention.

FIGS. 1*a*, 1*b*, and 2 show a much enlarged cross-section of three different line structure phosphor screens, each having three phosphors of different luminescent color, separated by a black background region. The phosphor screen 10, 10*a*, 10*b* comprises three primary colors, red 12, green 14, and blue 16, separated by black background regions 18. The cross-hatching is intended to identify the various colors. The scale is the same for all three drawings.

These are typical color screens for cathode ray tubes using three guns and a shadow mask to achieve color separation. FIG. 1*a* represents a HDTV (high density television) screen 10, while FIG. 1*b* typifies a super VGA (video graphic array) screen 10*a* in a computer terminal. The smallest dimensions of existing technology are shown in FIGS. 1*a* and 1*b*. The red 12, green 14, and blue 16 phosphors are shown in cross-section in uncalibrated vertical dimension. The black background layer 18 between the color lines is also shown.

Instead of lines, the structure can also consist of a triad of phosphor dots arranged in an equilateral triangular display; such triangular arrangements are well-known. Obviously, whatever is used must match mask and screen geometry. The same line structure and process can also be employed in a beam-indexed color tube. The structure and the process to build it are not limited to a cathode ray tube, but can also be employed in, for example, flat panel displays; e.g., electroluminescent, thin-film transistor-driven, plasma-driven low voltage phosphor flat panels, or flat panel-field emission cathode displays. Each method requires its own particular structural changes to accommodate the requirements of the driver mechanism. However, each method may be improved in accordance with the teachings of the present invention to provide a much lower triad pitch than heretofore available.

FIG. 2 shows a typical screen 10*b* structure for the above-described high resolution displays in accordance with the present invention. Both FIGS. 1 and 2 are drawn to the same horizontal scale to demonstrate the increased resolution capability of the proposed screen. The vertical scale is uncalibrated similar to FIG. 1. While the structure depicted in FIG. 2 is similar in appearance to those shown in FIG. 1, the very fine resolution capabilities of this screen requires a new and novel combination of technologies to build it. The line structure will be described as typical of the method, but other geometries can also be handled. The line structure is used with either a shadow mask cathode ray tube device, or with a flat panel display using a two-dimensional array of field emission or thermionic cathodes in register with the line structure of the screen.

The process of the present invention combines a modification of microelectronic processing techniques with electrophoretic plating of the phosphors 12, 14, 16 and the black screen 18. A specific application of electrophoretic plating, based on plating of positively charged particles on a negatively charged electrode and called cataphoretic plating, is described herein. However, it will be readily appreciated by those skilled in this art that anodophoretic plating may alternatively be employed, by plating negatively charged particles on a positively charged electrode.

Figure 3:
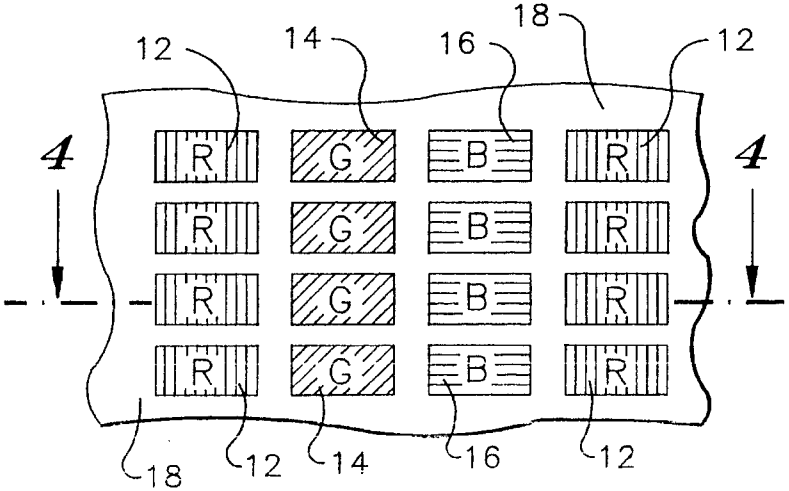
FIG. 3 is a top plan view of a portion of a TV screen fabricated by the process of the present invention.

A portion of the resultant TV screen 20 is shown in FIG. 3, which depicts the red, green, and blue stripes 12, 14, 16, respectively, in a repetitive pattern, each stripe surrounded by the black background regions 18.

A summary of the process steps is given below to outline the process of the invention.

Substrate 22, preferably glass, is first cleaned using a suitable cleaner. Such cleaners are well-known in this art. Next, the substrate 22 is coated with a photoresist, such as KTI-820 photoresist, available from Eastman Kodak Co. (Rochester, N.Y.). This material is a positive photoresist and is applied by spinning to a dry thickness of about 1.0 to 1.2 μm. The base line mask design is imaged on the substrate and exposed for alignment mark registration. Such imaging and exposing steps are well-known in the art of photolithography.

The alignment marks are developed in a developer that is conventional for the photoresist being used. The alignment marks are next etched into the substrate by any convenient etching technique, such as by reactive ion etch (RIE).

The remaining photoresist is removed from the substrate by stripping, such as in a plasma stripper. The substrate 22 is again cleaned.

The formation of the alignment marks described above is not depicted in the drawings. However, the following process steps are shown with reference to FIGS. 4*a–m*.

Figure 4A:
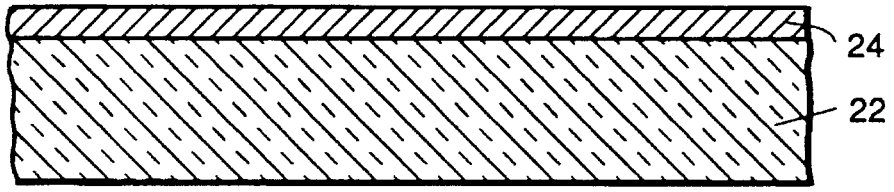
FIGS. 4*a*–m, taken along line 4—4 of FIG. 3, depict in cross-sectional view the various stages in the process of the present invention.

As shown in FIG. 4*a*, a conductive layer 24, such as aluminum, is deposited by DC sputtering onto the substrate 22 to a thickness of about 75 to 200 Å. The aluminum layer 24 serves as an electrode in electrophoretic plating, described in greater detail below with respect to cataphoretic plating. Aluminum is preferred, since it can be easily removed (e.g., rendered non-conducting and optically transparent) after all processing is finished.

Next, a photoresist layer 26, such as AZD4620, available from Hoechst Celanese Corporation (Somerville, N.J.), is applied, such as by spinning at 2,500 rpm for 60 seconds. The coated substrate is baked at 140° C. for 2 minutes, and then at 250° C. for 2.5 minutes to crosslink the photoresist layer 26. The photoresist layer 26 has a thickness range of about 4 to 10 μm, and preferably about 4 to 6 μm. At this stage, the entire AZD4620 layer 26 is now insensitive to electromagnetic radiation. It is not used as an imaging resist, but as a mask used in the cataphoretic coating step where a substantial thickness of phosphor must be built up in a restricted manner so as to avoid cross-contaminating the other color lines. The thickness of this layer is many times greater than that of the other layers. Also, the phosphor layer thickness must be tailored to the electron beam voltage. If the screen is too thin, electrons will penetrate completely through the phosphor layer, striking the glass substrate, and not producing as high a luminance as a proper thickness screen. Likewise, if a screen is overly thick, light output can be reduced and resolution will also suffer due to scattering of light in the phosphor layer.

A glass layer 28, such as Accuspin 311 spin-on-glass (SOG), available from Allied-Signal, Inc. (Milpitas, Calif.), is applied over the photoresist layer 26, such as by spinning at 3,000 rpm for 30 seconds to produce a thickness of about 2,000 to 3,000 Å. The glass layer 28 is baked at 140° C. for 2 minutes, then at 240° C. for 3 minutes. This layer 28 acts as an etch stop to protect the photoresist layer 26 while etching channels using an oxygen plasma in a later step.

The coated substrate is dipped in an ammonium hydroxide/hydrogen peroxide/water solution (1:1:5) to remove molecular impurities and to promote adhesion of an imaging resist, described below, to the SOG layer 28.

Hexamethylenedisilizane (HMDS) in xylene from Allied Chemical, Inc. (Morristown, N.J.) is then spun onto the coated substrate to further improve the adhesion of the imaging resist to the SOG layer 28, as is well-known in the semiconductor processing art. This thin film is not shown in the drawings. U.S. Pat. No. 3,549,368 issued to Collins et al discloses the use of hexaalkyldisilizanes for promoting the adhesion of photoresist to the substrate. The disilizane may be either added directly to the photoresist, or precoated on the substrate, as described above. Without subscribing to any particular theory, it is believed that in some manner, a part of the disilizane reacts with a surface oxide, forming a chemical bond to it, and that another part of the disilizane molecule bonds to the photoresist. It would appear that the HMDS film is extremely thin, possibly molecular.

A conventional positive imaging resist layer 30, such as KTI-820 photoresist, is next deposited over the SOG coating 28. The resist layer 30 is formed to a thickness of about 1 to 1.2 μm. It will be recalled that the photoresist layer 26 has been completely crosslinked and is not used herein as an imaging layer.

Figure 4B:
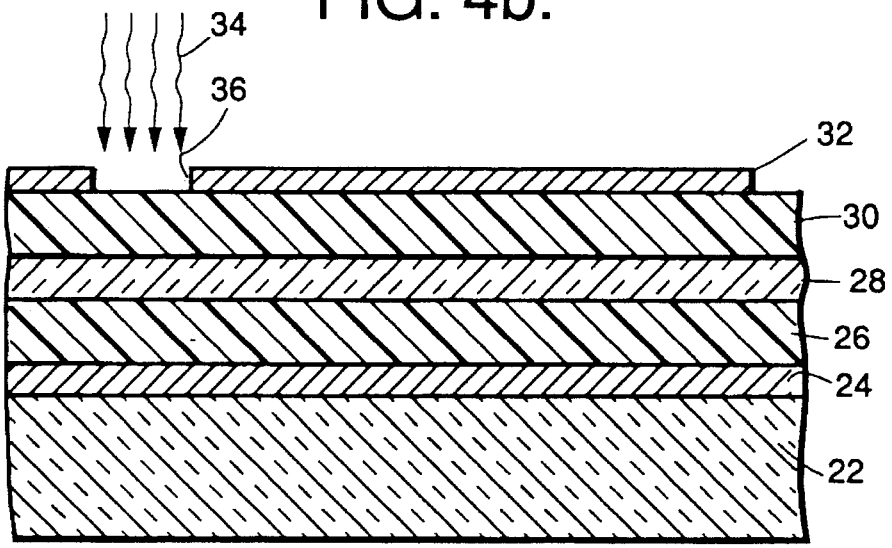

The desired pattern is exposed, using an appropriate non-contacting mask 32. Exposure is performed using conventional electromagnetic radiation 34 suitable for the photoresist 30. FIG. 4*b* depicts exposure of the top photoresist layer 30 to electromagnetic radiation 34 through the mask 32 having openings 36.

The portions exposed to the electromagnetic radiation are developed in a suitable developer, leaving openings 36 in layer 30. This process results in replication of the pattern through the top photoresist layer 30 to the SOG layer 28. Since this step and the next two steps are merely replicating opening 36 down through layers 30, 28, and 26, these steps are not depicted in the drawings.

Those portions of the SOG layer 28 exposed during the replicating process are subjected to a buffered oxide etch (BOE) until the pattern is etched completely through the SOG layer, thereby exposing underlying portions of the bottom photoresist layer 26. The buffered oxide etch is a conventional oxide/glass etchant used because of its selectivity of etching oxide/glass over photoresist. Traces of the etchant are rinsed and the coated substrate is dried.

Those portions of the bottom photoresist layer 26 exposed are etched, such as by reactive ion etching, thereby transferring the pattern to the surface of the aluminum-coated substrate.

Figure 4C:
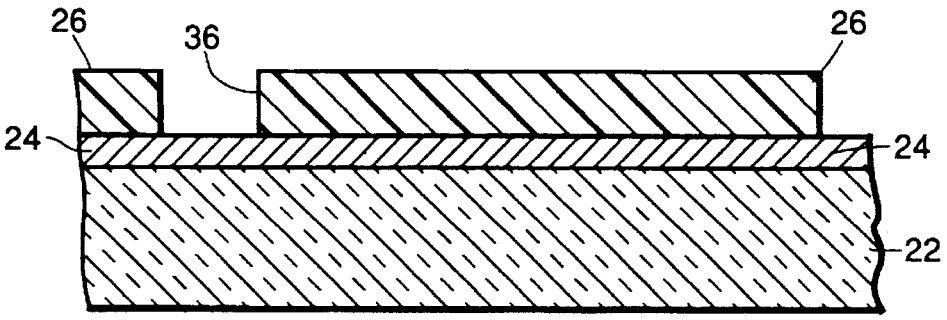

The remaining portions of the spin-on-glass layer 28 are removed, such as by etching in a BOE/glycerine mixture. The resulting structure is depicted in FIG. 4*c*. The BOE/glycerine mixture is used rather than a BOE solution alone, since the BOE/glycerin mixture does not affect the aluminum layer as does the normal BOE etch.

Figure 4D:
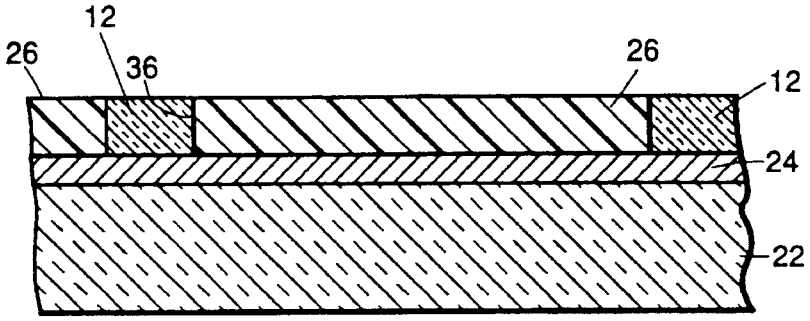

The first phosphor color 12 is coated on those exposed portions of the aluminum-coated substrate by cataphoretic plating. FIG. 4*d* depicts the structure resulting from the coating of the first phosphor 12.

The phosphor bath employed in the cataphoretic plating comprises:

The cataphoretic plating bath comprises 6 g of phosphor, 30 g of 3 mm glass beads, 20 ml of a solution of 1:1 glycerine and iso-propanol (isopropyl alcohol), and 1 ml of a solution of 200 ml of iso-propanol, 2 g of lantham nitrate, and 1 g of magnesium nitrate. This plating bath is prepared by pouting 10 ml of glycerine into ajar containing the 3 mm glass beads. The lanthanum nitrate and magnesium nitrate is dissolved in 10 ml of iso-propanol and then added to the jar. 6 g of phosphor is then added to the jar. This mixture is then rolled for about 2 hours to mix it and to positively charge the phosphor particles, and to form a phosphor slurry. The phosphor slurry is transferred into a plating tank, the remainder of the glycerine and iso-propanol is added to the tank, and the ingredients are mixed. The bath is then ready for use.

The concentrations of the components of the two solutions may be varied up to about ±15% with no adverse effects on the coating quality. Larger variations in concentration may require changing other variables to compensate. However, any such changes are considered to be within the skill of the practitioner in this art, and do not constitute undue experimentation.

The phosphors employed in the practice of the present invention include those phosphors, such as oxides and silicates, commonly employed in the fabrication of cathode ray tubes, flat panel displays, and other color displays.

The particle size of the phosphors ranges from less than 1 μm up to about 3 μm. The particles are suspended in the phosphor bath for cataphoretic plating.

Other cataphoretic plating bath compositions may also be employed in the practice of the present invention. The only criterion is that there is compatibility between the bath and the photoresist layers.

Cataphoretic plating using the above-mentioned plating bath is performed under the following conditions:

Voltage: 150 to 250 V, preferably about 200 V;

Current: 5 to 25 mA;

Time: 20 to 60 seconds;

Thickness: 4 to 6 μm.

The voltage controls the thickness of the phosphor and the time required to plate the phosphor. Higher voltages than indicated above would result in less plating time; however, such faster plating times would be difficult to control accurately.

The thickness of each phosphor layer 12, 14, 16 is related to the thickness of the bottom photoresist layer 26, in that it is convenient during subsequent processing that the phosphor layer be substantially the same as that of the bottom photoresist layer. This is also true for the black background layer 18. Thus, it is desired to time the cataphoretic plating so that the thickness of each phosphor layer 12, 14, 16 and the black matrix layer 18 is substantially the same as that of the bottom photoresist layer.

The substrate is then spun dry and baked to bind the phosphor 12. The baking removes any traces of water left in the phosphor layer 12 so as to permit the magnesium hydroxide formed during the electrolytic coating process, which accompanies the cataphoretic coating process to effectively bind the phosphor particles together and to the substrate surface.

Figure 4E:
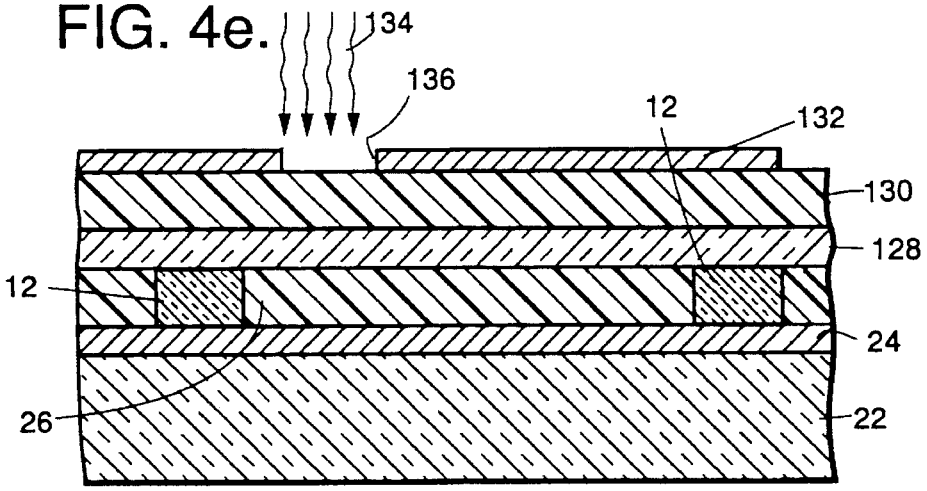
Figure 4F:
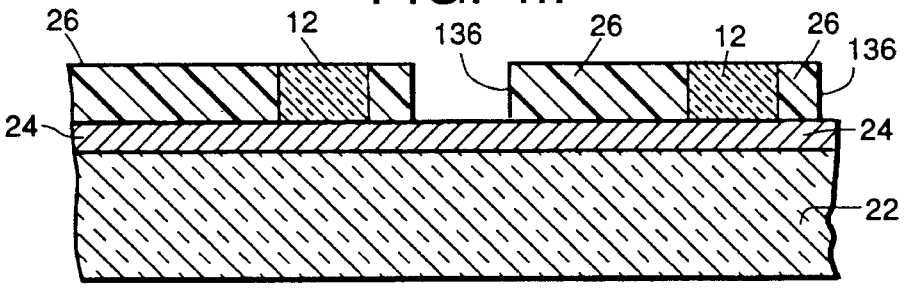
Figure 4G:
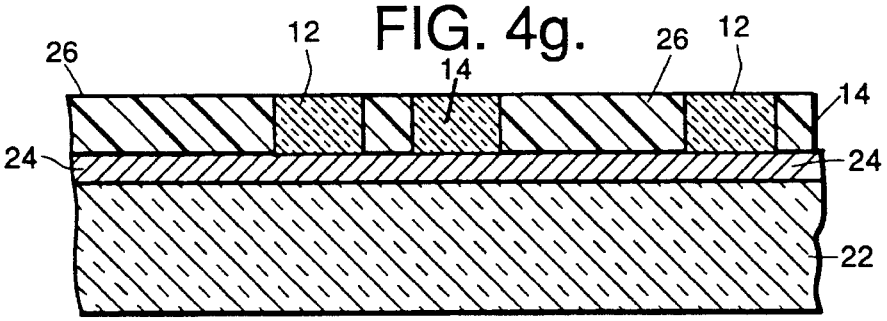

The substrate 22 now has the original aluminum layer 24, the first phosphor 12 stripe (or whatever pattern geometry is used), and the remaining crosslinked photoresist (bottom photoresist) layer 26. To apply the second phosphor 14 geometry, a layer of spin-on-glass 128 is again applied, then the substrate is dipped in the ammonium hydroxide/hydrogen peroxide/water solution referred to above, dried, and the SOG layer is coated with KTI 820 photoresist 130, as above. The same procedure as outlined above is followed in forming a second pattern for cataphoretically depositing the second phosphor 14, using mask 132, electromagnetic radiation 134, and developing to form openings 136. FIGS. 4*e–g*, analogous to FIGS. 4*b–d*, depict the exposure to electromagnetic radiation 134 (FIG. 4*e*), the structure just prior to cataphoretic coating of the second phosphor 14 (FIG. 4*f*), and the resulting structure following the coating of the second phosphor (FIG. 4*g*).

Figure 4H:
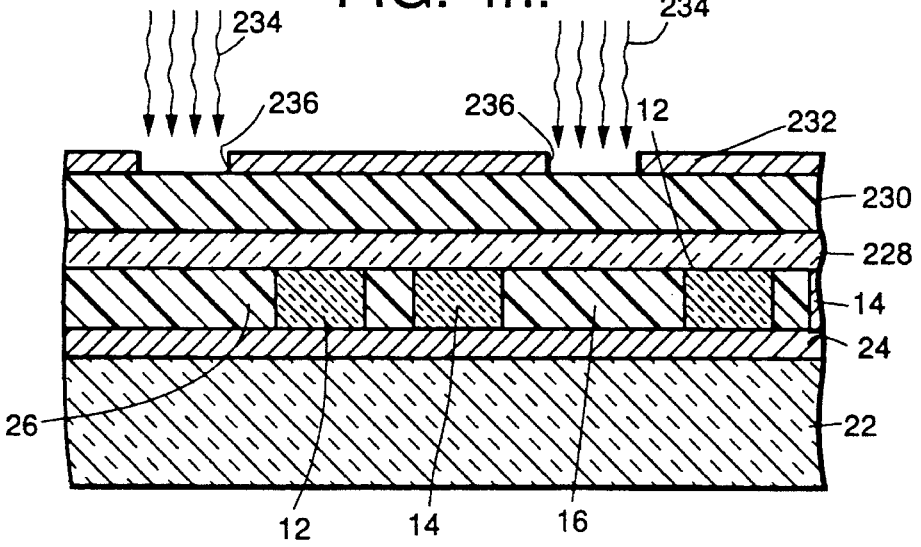
Figure 4I:
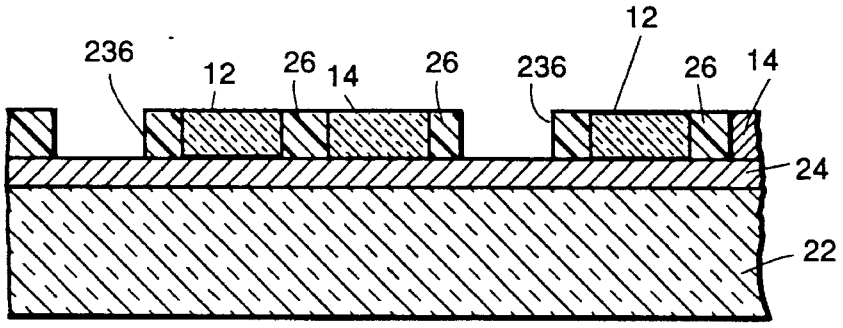
Figure 4J:
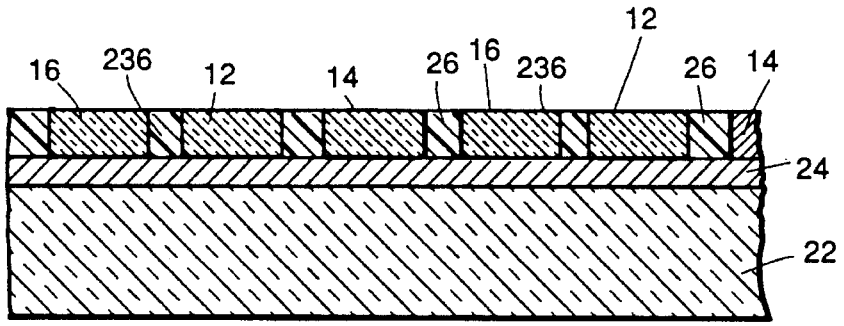
Figure 4K:
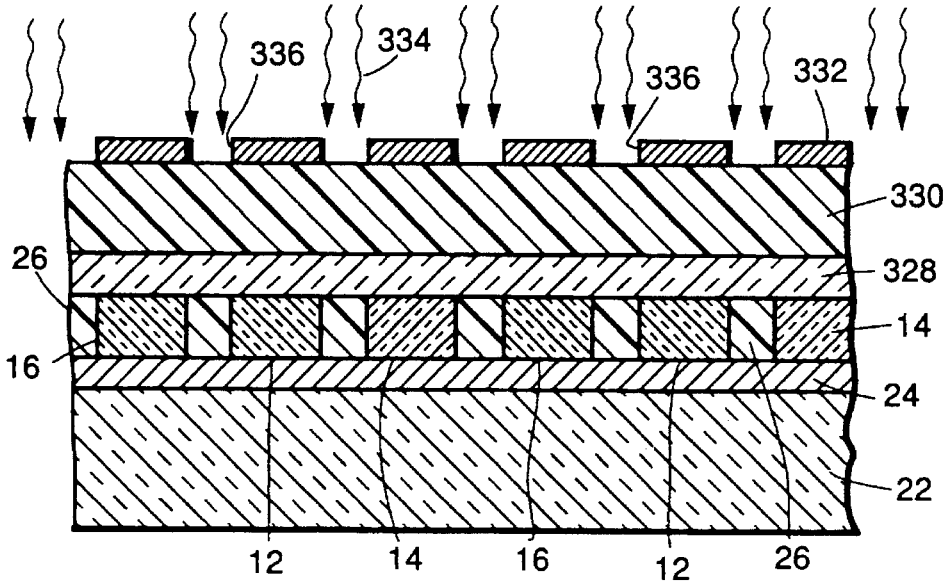
Figure 4L:
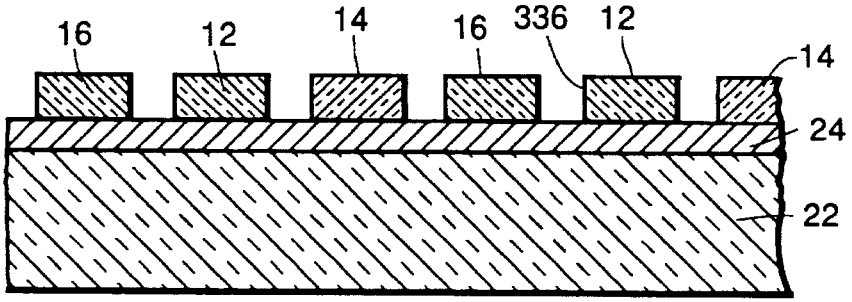

The foregoing steps are followed once again (SOG layer 228, top photoresist layer 230, mask 232, and electromagnetic radiation 234) to form openings 236 on the substrate 22 in order to cataphoretically deposit the third phosphor 16. FIGS. 4*h–j*, analogous to FIGS. 4*b–d*, depict the exposure to electromagnetic radiation 234 (FIG. 4*h*), the structure just prior to cataphoretic coating of the third phosphor 16 (FIG. 4*i*), and the resulting structure following the coating of the third phosphor 16 (FIG. 4*j*).

Figure 4M:
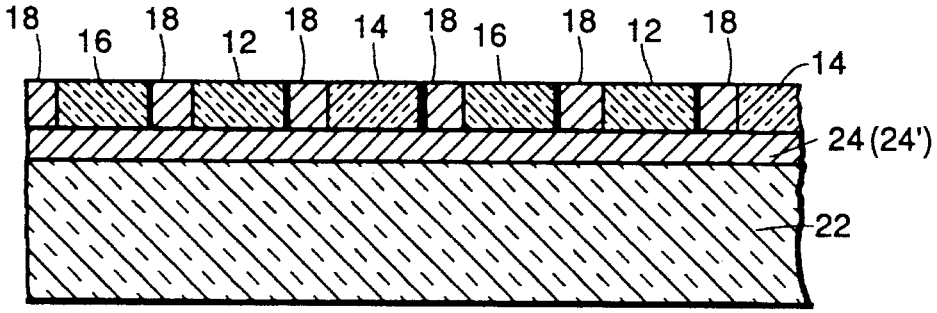

The foregoing steps are followed once again (SOG layer 328, top photoresist layer 330, mask 332, and electromagnetic radiation 334) to form openings 336 on the substrate 22 in order to cataphoretically deposit the black background material, or matrix, 18 surrounding each of the phosphor structures 12, 14, 16. During this process sequence, all remaining photoresist 26 is removed and replaced with the black material 18 FIGS. 4*k–m*, analogous to FIGS. 4*b–d*, depict the exposure to electromagnetic radiation 334 (FIG. 4*k*), the structure just prior to cataphoretic coating of the black material 18 (FIG. 41), and the resulting structure following the cataphoretic coating of the black material 18 (FIG. 4*m*). Cataphoretic plating of the black matrix 18 is done under the conditions described above, using a suspension of manganese carbonate particles in the cataphoretic plating bath, having a particle size of less than 1 μm.

With all three colors 12, 14, 16 and the black surround material 18 applied, the bottom photoresist layer 26 has been completely removed through the four reactive ion etches performed in the three color and the black material applications. Thus, no separate step is required for the removal of the bottom photoresist layer 26. The bottom aluminum layer 24 is converted to an aluminum oxide with a bake-out at 400° C. for 35 to 45 minutes. This is an air oxidation step which oxidizes the thin aluminum film to form a transparent aluminum oxide layer 24', which is invisible in screen operation. FIG. **4*m* depicts the structure following oxidation to form layer 24'. At the same time, this baking step converts the manganese carbonate into manganese dioxide, which, being black, comprises the black matrix material 18**.

The next step depends upon what sort of device the completed screen will be used in. If it is to be made into a cathode ray tube (CRT), the screen is first aluminized by conventional means well-known in the art. If the screen is to be used in low voltage display panels, aluminizing is not required. In this latter case, the screen may be used as it exits from the aluminum conversion bake step after conventional inspection procedures.

While each the foregoing steps is conventional in microelectronic processing, the novel part of the processing consists of two unusual procedures. First, all microelectronic processing (external to the present invention) currently makes use of very thin films of photoresist, spin-on-glass, etc. Because the phosphor screen must have a greater depth to it as compared to the types of films used in microelectronic manufacturing, a change is required in the photoresist. The photoresist used in the practice of the present invention must be capable of forming a cross-linked layer of the thickness required for the phosphor film, namely, on the order of 4 to 6 μm. This is in contrast to photoresists conventionally employed in microelectronic processing, which are on the order of 1,000 to 3,000 Å(0.1 to 0.3 μm). The much thicker bottom photoresist layer 26 is obtained by using special resist materials, such as AZD4620.

In addition, the photoresist must be "non-toxic" to the phosphors. Various metallic elements which are present in conventional photoresists can change the color and/or light output of the phosphors when the completed screens are subjected to the baking processes normally required for fabricating the screens into vacuum devices. Also, as a result of the cataphoretic coating process discussed in the next paragraph, the photoresists and other layers used during the microelectronic processes must be compatible with the cataphoretic coating process. In particular, the photoresists used must be inert to the iso-propanol, a major constituent of the cataphoretic coating bath.

The second unusual procedure is the electrophoretic coating process. While this is not an unusual procedure in itself, inasmuch as some specialized cathode ray tubes use the process, the application of the process to these high resolution displays disclosed herein is necessary due to the very small particle size phosphors (less than 1 up to 3 μm) required to produce the fine line structure for high resolution. Conventional color screens are made by using phosphors embedded in photosensitized materials, e.g., chromium-sensitized polyvinyl alcohol. These slurries are viscous and form screens that are much too thick for the high resolution of the present invention. In addition, the exposure of these photosensitized phosphor slurries, after drying, cannot produce lines of the size shown in FIG. 2, since ultraviolet (UV) light is diffused by the phosphor particles as it travels through the phosphor layer. If shorter exposure times are used, the phosphor-photoresist layer is not cured all the way through the layer so that the lines or dot structure does not adhere to the substrate during development.

Electrophoretic coating, on the other hand, is well-suited for these very fine particle size phosphors, since it provides a tightly bonded, dense screen structure. It is superior to screens prepared by other means, such as settling, centrifuging, and slurrying, since the screens produced herein have much enhanced optical properties compared to the methods mentioned. The electrophoretic coating process produces screens in which the phosphor particles are tightly packed, producing enhanced optical and physical properties.

Initial fabrication of phosphor screens in accordance with the teachings herein was done with phosphor stripes ranging in color line widths from 5 to 50 μm and spacings between phosphors, filled with the black matrix material, ranging from 5 to 15 μm. While adequate cataphoretic plating was achieved at color line widths of 5 μm under the conditions described herein, best results were obtained at color line widths of at least 15 μm. Since this is also the extreme lower limit of present cathode ray tube electron gun resolution, this result is considered to be acceptable.

Subsequent fabrication done with 15 μm color line widths and 5 μm black matrix width demonstrated the feasibility of such a combination, which provides a triad pitch of 60 μm.

For CRTs with high voltage operation, the phosphors and black matrix are formed to a thickness within the range of about 4 to 6 μm, as indicated above. For flat panels, the thickness ranges from about 3 to 10 or 15 μm, depending on the particular type of flat panel display.

Thus, there has been disclosed a method of fabricating a three-color screen having a triad pitch of less than 150 μm on a substrate. It will be readily apparent to those skilled in this art that various changes and modifications of an obvious nature may be made, and all such changes and modifications are considered to fall within the scope of the invention, as defined by the appended claims.

What is claimed is:

1. A method of fabricating a three-color screen on a substrate, comprising:

(a) providing a substrate;

(b) forming an opaque conductive coating of aluminum on said substrate;

(c) forming a masking layer on said conductive coating;

(d) patterning said masking layer to form a first plurality of openings therein to expose first portions of said conductive coating;

(e) electrophoretically depositing a first phosphor, for emitting a first color, on said exposed first portions of said conductive coating;

(f) repeating steps (c) through (e) three additional times (1) to deposit a second phosphor, for emitting a second color, on second portions of said conductive coating, (2) to deposit a third phosphor, for emitting a third color, on third portions of said conductive coating, and (3) to deposit a black layer on remaining portions of said conductive coating, surrounding all three phosphor deposits, to define a plurality of triads of said first, second, and third colors in spaced relationship, separated by said black layer; and (g) oxidizing said conductive coating to convert said conductive coating to a transparent non-conductive coating of aluminum oxide and retaining said non-conductive coating on said substrate beneath said plurality of triads and said black layer.

2. The method of claim 1 wherein said aluminum coating has a thickness of about 75 to 200 Å.

3. A method of fabricating a three-color screen on a substrate, comprising:

(a) providing a substrate;

(b) forming a conductive coating on said substrate;

(c) forming a masking layer on said conductive coating that comprises a bottom photoresist layer, a spin-on-glass layer, and top photoresist layer, wherein said bottom photoresist layer has a thickness;

(d) patterning said masking layer to form a first plurality of openings therein to expose first portions of said conductive coating, wherein said openings have sides with a height corresponding to said thickness of said bottom photoresist layer;

(e) electrophoretically depositing a first phosphor, for emitting a first color, within said sides on said exposed first portions of said conductive coating, wherein said first phosphor is deposited to a depth substantially equal to said height of said openings;

(f) repeating steps (c) through (e) three additional times (1) to deposit a second phosphor, for emitting a second color, on second portions of said conductive coating, (2) to deposit a third phosphor, for emitting a third color, on third portions of said conductive coating, and (3) to deposit a black layer on remaining portions of said conductive coating, surrounding all three phosphor deposits, to define a plurality of triads of said first, second, and third colors in spaced relationship, separated by said black layer; and (g) oxidizing said conductive coating to convert said conductive coating to a non-conductive coating and retaining said non-conductive coating on said substrate beneath said plurality of triads and said black layer.

4. The method of claim 3 wherein said bottom photoresist layer consists essentially of a photosensitive material (1) that forms said layer having said thickness of at least 4 μm (2) is non-toxic to said phosphors, and (3) is chemically inert with respect to iso-propanol.

5. The method of claim 4 wherein said thickness of said bottom photoresist layer is from about 4 to 10 μm.

6. The method of claim 4 further comprising exposing said bottom photoresist layer to heat to completely crosslink it.

7. The method of claim 3 wherein said spin-on-glass layer has a thickness from about 2,000 to 3,000 Å.

8. The method of claim 3 wherein said top layer photoresist layer consists essentially of a positive imaging photosensitive material.

9. The method of claim 8 wherein said top photoresist layer has a thickness from about 1 to 1.2 μm.

10. The method of claim 3 further comprising treating said spin-on-glass layer prior to coating said top photoresist layer thereon by dipping said substrate coated with said spin-on-glass layer in a solution comprising ammonium hydroxide/hydrogen peroxide/water to form a treated spin-on-glass layer to promote adhesion of said top photoresist thereto.

11. The method of claim 10 further comprising applying a film of a hexaalkyldisilizane to said treated spin-on-glass layer prior to coating said top photoresist layer thereon to further promote adhesion of said top photoresist thereto.

12. The method of claim 3 further comprising exposing said top photoresist layer to electromagnetic radiation through a mask to form said pattern, developing said exposed portions in a developer solution to expose underlying portions of said spin-on-glass layer, subjecting said exposed portions to a buffered oxide etch to expose underlying portions of said bottom photoresist layer, and removing said exposed portions of said bottom photoresist layer by reactive ion etching to transfer said pattern from said mask to said conductive coating.

13. The method of claim 12 further comprising removing said top photoresist layer and then removing said spin-on-glass layer, prior to said electrophoretic plating.

14. The method of claim 13 further comprising removing said spin-on-glass layer in a buffered oxide/glycerine solution.

15. The method of claim 1 wherein said electrophoretic plating is performed using a plating bath formed by mixing a first solution including 6 g of phosphor, 30 g of 3 mm glass beads, 50 ml of a solution "A", comprising a solution of 1:1 glycerine and iso-propanol, and 1 ml of a solution "B", comprising a solution of 200 ml of iso-propanol, 2 g of lanthanum nitrate, and 1 g of magnesium nitrate with a second solution comprising 1,950 ml iso-propanol, wherein each component of said first and second solutions has a concentration within about +15% of that given.

16. The method of claim 15 wherein said electrophoretic plating is performed under the conditions of:

Voltage: about 150 to 250 V

Current: 5 to 25 mA

Time: 20 to 60 sec.

17. The method of claim 1 wherein each of said phosphor deposits has a different color and a maximum of about 15 μm color line width, and is separated by a maximum of about 5 μm spacings comprising said black layer.

18. The method of claim 1 wherein said first, second, and third phosphors and said black layer are formed to a thickness within the range of about 3 to 15 μm.

19. A method of fabricating a three-color screen on a substrate, comprising:

(a) providing a substrate;

(b) forming a conductive coating on said substrate;

(c) forming a masking layer on said conductive coating that comprises a bottom photoresist layer, a spin-on-glass layer, and top photoresist layer, wherein said bottom photoresist layer is a crosslinkable composition;

(d) heating said crosslinkable composition at a temperature and for a time sufficient to substantially crosslink said composition, rendering said bottom photoresist layer substantially insensitive to electromagnetic radiation;

(e) patterning said masking layer to form a first plurality of openings therein to expose first portions of said conductive coating;

(f) electrophoretically depositing a first phosphor, for emitting a first color, on said exposed first portions of said conductive coating;

(g) repeating steps (c) through (f) three additional times (1) to deposit a second phosphor, for emitting a second color, on second portions of said conductive coating, (2) to deposit a third phosphor, for emitting a third color, on third portions of said conductive coating, and (3) to deposit a black layer on remaining portions of said conductive coating, surrounding all three phosphor deposits, to thereby define a plurality of triads of said first, second, and third colors in spaced relationship, separated by said black layer; and (g) oxidizing said conductive coating to convert said conductive coating to a non-conductive coating and retaining said non-conductive coating on said substrate beneath said plurality of triads and said black layer.

20. The method of claim 19 wherein said openings have sides with a height corresponding to a thickness of said bottom photoresist layer and said first, second and third phosphors are deposited within said openings to a depth substantially equal to said height of said sides and wherein said height of said sides is from about 4 to 10 μm.

* * * * *

UNITED STATES PATENT AND TRADEMARK OFFICE

CERTIFICATE OF CORRECTION

PATENT NO. : 5,582,703

DATED : December 10, 1996

INVENTOR(S) : Esther Sluzky et al.

It is certified that error appears in the above-identified patent and that said Letters Patent is hereby corrected as shown below:

Column 5, line 30: delete "pouting" and insert -- pouring --.

Column 5, line 31: delete "ajar" and insert --a jar--.

Column 6, line 53: after "18" insert -- . --.

Signed and Sealed this

Fifteenth Day of April, 1997

*Attest:*

BRUCE LEHMAN

*Attesting Officer*

*Commissioner of Patents and Trademarks*